US006785933B2

(12) United States Patent
Kim et al.

(10) Patent No.: US 6,785,933 B2
(45) Date of Patent: Sep. 7, 2004

(54) SUCTION HEAD OF VACUUM CLEANER WITH POWER BRUSH

(75) Inventors: Tae Heoung Kim, Gwangmyeong (KR); Seung Hee Ryu, Anyang (KR)

(73) Assignee: LG Electronics Inc., Seoul (KR)

( * ) Notice: Subject to any disclaimer, the term of this patent is extended or adjusted under 35 U.S.C. 154(b) by 108 days.

(21) Appl. No.: 10/043,167

(22) Filed: Jan. 14, 2002

(65) Prior Publication Data

US 2002/0184732 A1 Dec. 12, 2002

(30) Foreign Application Priority Data

Jun. 9, 2001 (KR) ..... 2001/32331

(51) Int. Cl.[7] ..... A47L 9/04

(52) U.S. Cl. ..... 15/364; 15/380; 15/389; 15/392; 15/377

(58) Field of Search ..... 15/364, 380, 389, 15/392, 377

(56) References Cited

U.S. PATENT DOCUMENTS

| | | | | | |
|---|---|---|---|---|---|
| 1,914,834 | A | * | 6/1933 | Otto | 15/377 |
| 1,953,340 | A | * | 4/1934 | Doemling | 15/389 |
| 4,268,769 | A | * | 5/1981 | Dorner et al. | 15/377 |
| 5,901,411 | A | * | 5/1999 | Hato et al. | 15/377 |
| 6,134,745 | A | * | 10/2000 | Worwag | 15/383 |
| 6,314,611 | B1 | | 11/2001 | Sauers | 15/376 |
| 6,323,570 | B1 | * | 11/2001 | Nishimura et al. | 15/392 |
| 6,463,623 | B2 | | 10/2002 | Ahn et al. | 15/389 |

FOREIGN PATENT DOCUMENTS

| | | | |
|---|---|---|---|
| DE | 10126354 | A1 | 5/2001 |
| EP | 0947155 | A2 | 10/1999 |
| EP | 1297773 | A1 | 4/2003 |
| GB | 2333443 | A | 7/1999 |
| JP | 58-118659 | | 9/1979 |
| JP | 110042184 | A | 12/1995 |
| JP | 070327884 | A | 2/1999 |
| JP | 11-313786 | | 11/1999 |
| JP | 2000-354569 | | 12/2000 |
| JP | 2001-371 | A | 1/2001 |
| KR | 2002095526 | | 12/2002 |
| WO | WO 93/11695 | A1 | 6/1993 |

* cited by examiner

*Primary Examiner*—Theresa T. Snider
(74) *Attorney, Agent, or Firm*—Fleshner & Kim, LLP

(57) ABSTRACT

A suction head of a vacuum cleaner with a power brush to dislodge and remove debris from an object to be cleaned is provided. The suction head includes a head case connected to a cleaner body via a connecting tube and having a suction hold on a lower surface thereof, a power brush positioned in the head externally protruding from the head case through the suction hole allowing contact with an object to be cleaned, a supporting unit fixed in the head case for supporting the power brush to allow rotary and linear movements thereof, a rotary operating unit positioned between the supporting unit and the power brush for rotating the power brush, and a linear operating unit installed between the supporting unit and power brush for moving the power brushing linearly. With such structure, the size of the suction head is reduced and cleaning performance is improved.

20 Claims, 3 Drawing Sheets

SUCTION HEAD OF VACUUM CLEANER WITH POWER BRUSH

BACKGROUND OF THE INVENTION

1. Field of the Invention

The present invention relates to a suction head of a vacuum cleaner and particularly, to a suction head of a vacuum cleaner which rotatively contacts with an object to be cleaned to dislodge and suck up debris from the object.

2. Description of the Background Art

Generally, a vacuum cleaner is a cleaning instrument for collecting and absorbing debris such as dust and the like existing on an object to be cleaned, such as a carpet using a suction force generated by operation of a fan motor assembly.

Among conventional vacuum cleaners, a vacuum cleaner having a power brush which is also called an agitator in a suction head to improve cleaning performance is known. The power brush removes debris from the object by rotatively brushing or agitating the object to be cleaned to dislodge debris therefrom.

As shown in FIG. 1, the conventional vacuum cleaner having the power brush includes a cleaner body 1 having a fan motor assembly for generating a suction force to suck debris such as dust and the like existing on the object to be cleaned, a connecting tube 5 which is a passage extending from the cleaner body 1 receiving debris, and a suction head 10 connected to the end of the connecting tube 5 for sucking in debris upon contacting with or being in proximity to the object to be cleaned.

Particularly, in the suction head 10, a power brush 20 is installed for dislodging or agitating debris existing on the object to be cleaned.

The structure of the suction head having the power brush will be described with reference to FIG. 2.

The suction head 10 includes a head case 11 connected to the connecting tube 5 shown in FIG. 1 and having a suction hole 15 in the lower surface thereof for sucking debris, a power brush 20 partially protruding through the suction hole 15 of the head case 11, and rotatively contacting the object to be cleaned, a rotation shaft 25 rotatably installed in the head case 11 for supporting the power brush 20, and an electric motor 30 fixed with the head case 11 for rotating and driving the power brush 20 via the rotation shaft 25.

Here, the power brush 20 has a cylindrical shape and the rotation shaft 25 is rotatably connected to the center portion of both sides of the power brush 20. On the outer circumferential surface of the power brush 20, bristles 22 are positioned in a spiral direction along the rotation shaft 25 to allow contacting and brushing of an object to be cleaned.

The electric motor 30 is fixed in a parallel manner to the power brush 20 and the rotation shaft 25 and pulleys 33 and 34 are respectively positioned on the shaft 31 of the electric motor 30 and the rotation shaft 25. The pulleys 33 and 34 are mutually connected by the belt 35, and accordingly, the driving force generated by the electric motor 30 can be transmitted to the power brush 20.

In the vacuum cleaner having the conventional power brush with the above described structure, when the fan motor assembly in the cleaner body 1 is operated, a suction force is generated in the head case 11 of the suction head 10. At this time, debris such as dust and the like existing on the object to be cleaned are sucked through the suction hole 15 of the head case 11.

When electric power is supplied to the electric motor 30 in the suction head 10, the power brush 20 rotates and dislodges debris from the object to be cleaned as it contacts with and brushes the surface thereof. The dislodged debris is sucked through the suction hole 15 by the suction force generated in the cleaner body 1.

The suction head of the vacuum cleaner having the conventional power brush has problems in that additional space is required in the suction head 10 for installing the electric motor 30 therein and the size of the suction head 10 is undesirably large because the electric motor 30 is installed externally from the power brush 20 to provide rotation thereof.

Also, the suction head of the vacuum cleaner having the conventional power brush also has a problem in that the belt 35 which transfers the driving force of the electric motor 30 to the power brush can become loose after prolonged use and the rotary operation of the power brush 20 is not smoothly progressed, thus vacuum cleaning efficiency is lowered.

Particularly, the suction head of the vacuum cleaner having the conventional power brush also has a problem in that debris on the object to be cleaned are not easily removed because the power brush contacts or brushes the object to be cleaned only in the direction that the power brush rotates, thus the vacuum cleaning operation is limited.

SUMMARY OF THE INVENTION

Therefore, the present invention was developed to solve at least the above-identified problems of the conventional art by providing a suction head of a vacuum cleaner with a power brush capable of achieving a more compact design with minimum suction head size by installing a motor and the like which provide a driving force to the power brush inside the power brush structure itself.

Also, another object the present invention is to provide a suction head of a vacuum cleaner with a power brush capable of improving the performance of dislodging or removing debris from an object to be cleaned by forming a structure where the power brush can simultaneously perform rotary and linear movements, thus to improve vacuuming operation.

To achieve these and other advantages and in accordance with the purpose of the present invention, as embodied and broadly described herein, there is provided a suction head of a vacuum cleaner with a power brush including a head case connected to a cleaner body via a connecting tube and having a suction hole in a lower surface thereof, a power brush positioned in the head case and externally protruding from the head case through the suction hole allowing contact with the object to be cleaned, a supporting means fixed in the head case for supporting the power brush to allow rotary and linear movements thereof, a rotary operating means installed between the supporting means and the power brush within the power brush itself for rotatively operating the power brush, and a linear operating means installed between the supporting means and the power brush within the power brush itself for horizontally reciprocating the power brush along the supporting member.

The power brush can be formed to have a cylindrical shaped body having a plurality of bristles arranged in a spiral shape on the circumferential surface thereof.

The supporting means preferably includes a supporting shaft having both ends fixed on the inner walls of the head case under the such that the supporting means protrudes from the power brush, a linear moving guide means positioned between the supporting shaft and the power brush for guiding the power brush to move linearly along the supporting shaft, and a bearing installed between the linear moving guiding means and the power brush for facilitating the rotation of the power brush.

The linear moving guide means is preferably a guide bush having a cylindrical shape and fixed with the supporting shaft, and combined coupling with an inner face of the bearing in a serration structure to allow mutual inter-locking thereof in the rotary direction.

The guide bush has a stopper for restricting the linear movement of the power brush at its both end portions, and the guide bush has a hole allowing an electric cable to pass therethrough so that electric power can be supplied to the rotary operating means and the linear operating means.

The rotary operating means is preferably a rotary type motor including a stator fixed to the supporting means and a rotor fixed on the inner circumferential surface of the power brush.

The linear operating means preferably includes a solenoid coil fixed to the supporting means for generating electromagnetic flux, a moving core fixed to the inner circumferential surface of the power brush for generating a linear moving force by the flux generated by the solenoid coil, and an elastic means supported in the head case for generating an opposing force to oppose a force generated between the solenoid coil and the moving core.

The elastic means is preferably installed between both side surfaces of the power brush and both inner wall surfaces of the head case, respectively, and provides an elastic force so that the power brush performs linear vibrating movement in the longitudinal direction.

Also, the suction head of a vacuum cleaner with a power brush includes a head case connected to a cleaner body via a connecting tube and having a suction hole in a lower surface thereof, a power brush positioned in the head case and protruding externally from the head case through the suction to allow contact with and brushing of an object to be cleaned, a supporting means fixed in the head case for supporting the power brush to allow rotation thereof, and a rotary operating means installed between the supporting means and power brush for rotating the power brush.

Also, the suction head of a vacuum cleaner with a power brush includes a head case connected to a cleaner body via a connecting tube and having a suction hole in a lower surface thereof, a power brush positioned in the head case and protruding externally from the head case through the suction hole to thus contact and brush the object to be cleaned, a supporting means fixed in the head case for supporting the power brush to be capable of performing linear movements, and a linear operating means installed between the supporting means and power brush for moving the power brush linearly.

As described above, the present invention has advantages in that the size of the suction head can be reduced and cleaning performance can be improved by improving the operation of dislodging debris from the object to be cleaned.

The foregoing and other, features, aspects and advantages of the present invention will become more apparent from the following detailed description when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

A plurality of embodiments for a suction head of a vacuum cleaner with a power brush in accordance with the present invention are possible and hereinafter, the most desirable embodiment will be described.

Figure 1:
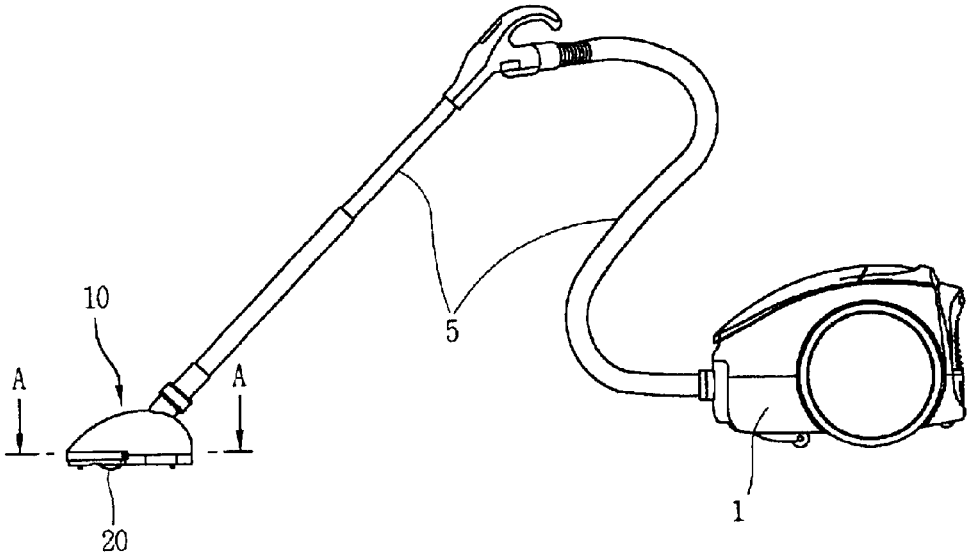
FIG. 1 CONVENTIONAL ART
FIG. 1 shows a conventional vacuum cleaner.
Figure 2:
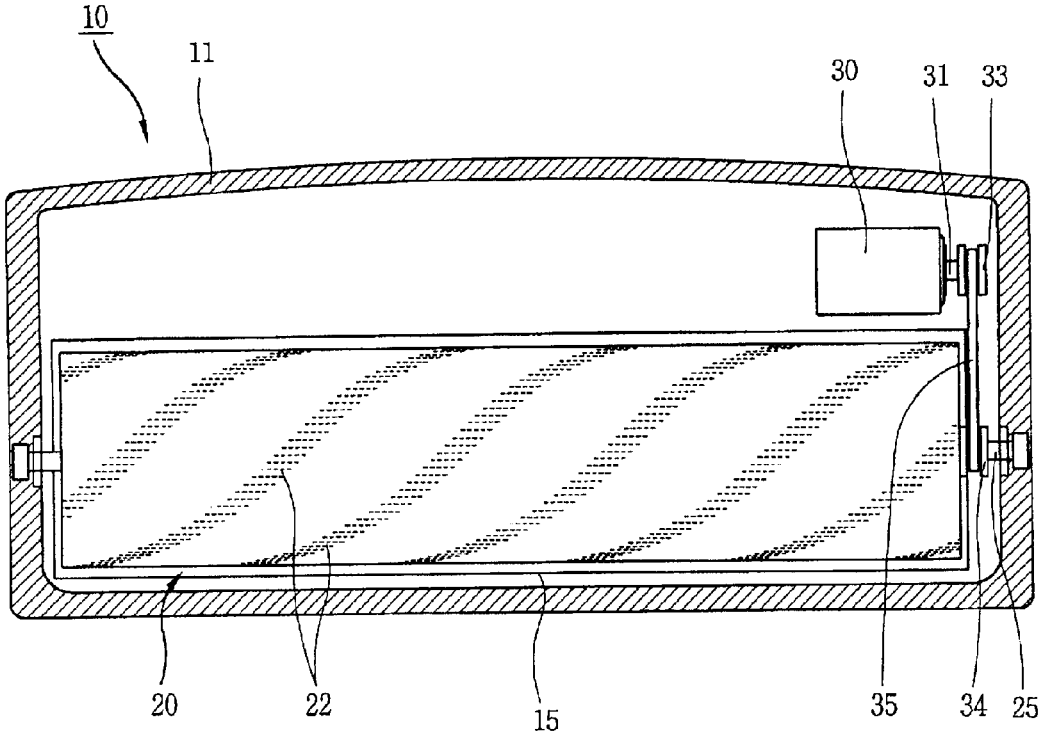
FIG. 2 CONVENTIONAL ART
FIG. 2 is a cross-sectional view taken along section line A—A of FIG. 1 showing a suction head of the vacuum cleaner with a conventional power brush.
Figure 3:
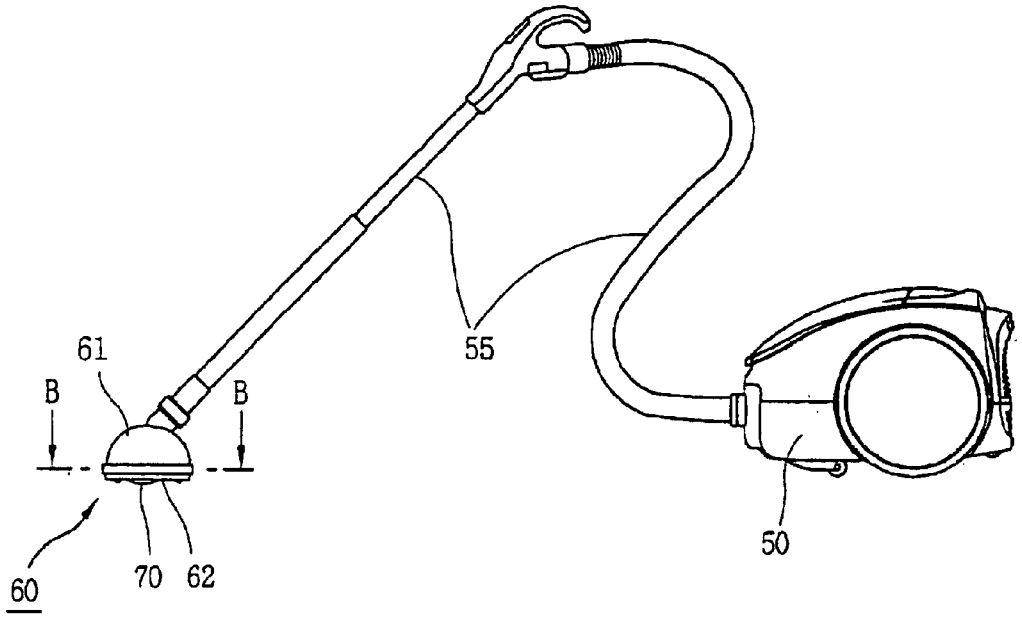
FIG. 3 is a side view showing a vacuum cleaner with a power brush in accordance with the present invention.
Figure 4:
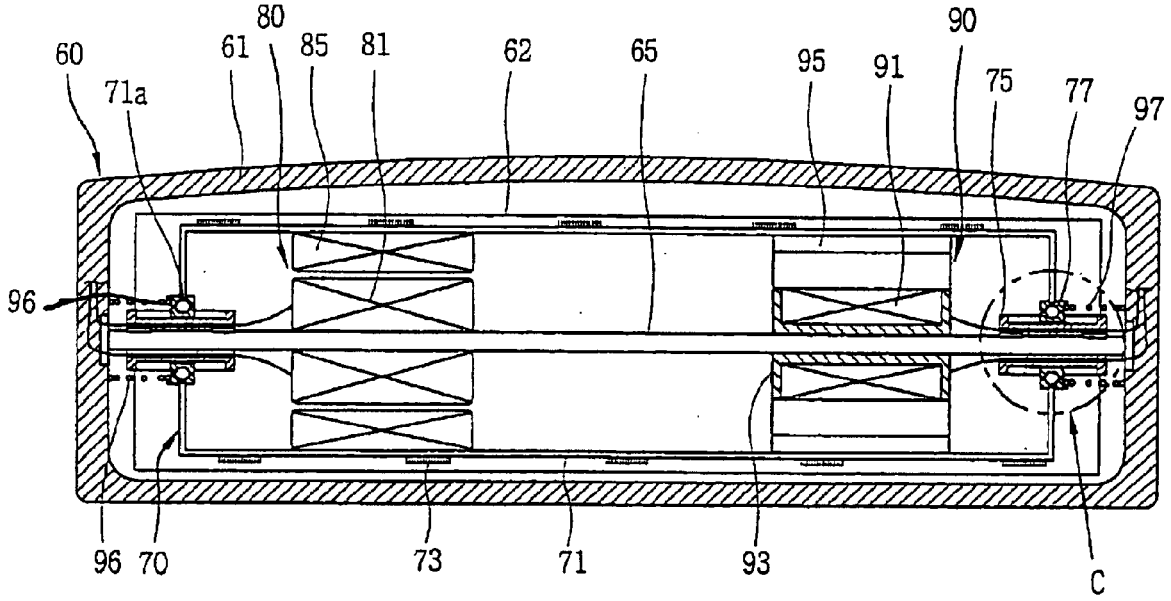
FIG. 4 is a cross-sectional view taken along section line B—B of FIG. 3 showing a suction head of the vacuum cleaner with a power brush in accordance with the present invention.

FIG. 3 is a side view showing a vacuum cleaner with a power brush in accordance with the present invention and FIG. 4 is a cross-sectional view taken along section line B—B of FIG. 3 showing a suction head of the vacuum cleaner with a power brush in accordance with the present invention.

With reference to FIG. 3, the vacuum cleaner includes a cleaner body 50 having a fan motor assembly for generating suction force and a collecting room for collecting debris, a connecting tube 55 extending from the cleaner body 50 which is a passage for suctioned debris, and a suction head 60 positioned at the end of the connecting tube 55, for absorbing debris such as dusts and the like from the object to be cleaned.

Here, in the suction head 60, a power brush 70 is installed for enabling debris from the object to be cleaned by rotatably brushing the object to be cleaned.

With reference to FIG. 4, the suction head 60 includes a head case 61 connected to the cleaner body 50 via the connecting tube 55, a supporting shaft 65 installed and extending in the longitudinal direction of the head case in the head case 61, the power brush 70 combined with the supporting shaft to be relatively movable in the linear direction and in the rotational direction to the supporting shaft 65, a rotary operating device 80 installed within the power brush 70 for rotating and operating the power brush 70, and a linear operating device 90 installed in the power brush 70 for moving the power brush 70 in the shaft direction of the supporting shaft 65.

Here, in the lower surface of the head case 61, a suction hole 62 is formed in the horizontal direction (as shown in Fig.4) to suck air and debris from an object to be cleaned.

The supporting shaft 65 has both end portions fixed to the inner walls of both sides of the head case 61 and is positioned in parallel to the longitudinal direction of the suction hole 62.

The power brush 70 includes a body part 71 having a cylindrical shape with a central hole and a brush part 73 installed in a spiral configuration on the outer circumferential surface of the body part 71. On both side walls of the body part 71, holes 71a for receiving the supporting shaft 65 are formed.

The rotary operating device 80 includes a stator 81 attached with the supporting shaft 65 as a single body by press fitting or other attaching methods is and a rotor 85 fixed on the inner circumferential surface of the body part 71 of the power brush 70 to face the stator 81 and having a certain gap therebetween, the body part 71 being rotated by the interaction with between the rotor 85 the stator 81.

Such rotary operating device 80 has the same or similar structure with that of common rotary motors.

The linear operating device 90 includes a solenoid coil 91 wound around a portion of the supporting shaft 65 for generating electromagnetic flux, a moving core 95 attached with the body part 71 of the power brush 70 to be movable as a single body for forming a magnetic path where the flux passes around the solenoid coil 91, and springs 96 and 97 supported on the inner walls of both sides of the head case 61 for providing an elastic force so that the power brush 70 can reciprocate in the horizontal direction along the shaft 65 when the power brush is linearly operated.

Here, the solenoid coil 91 is wound around a bobbin 93 fixed on the supporting shaft 65 and preferably positioned at the center part of the moving core 95. The moving core 95 has a cylindrical structure being fixed in the power brush and generates a linear driving force due to the difference of magnetic resistance by the magnetic flux generated at the solenoid coil 91.

The springs 96 and 97 are composed of common coil springs, and in the embodiment of the present invention, the springs 96 and 97 are installed at both sides of the power brush 70. However, the springs 96 and 97 can be installed at just one side so that the force opposed to the linear moving force generated by the solenoid coil 91 and moving core 95, namely the force to move the power brush to the original position is supplied.

The rotary operating device 80 and linear operating device 90 are respectively installed to both side positions of the supporting shaft 65 inside the power brush 70, and generate driving force to make the power brush 70 perform rotary and linear movements.

To enable rotary and linear movements of the power brush 70 around the supporting shaft 65 by the rotary operating device 80 and linear operating device 90, a moving supporting means for enabling rotary and linear movements of the power brush 70 is installed between the supporting shaft 65 and the power brush 70.

Figure 5A:
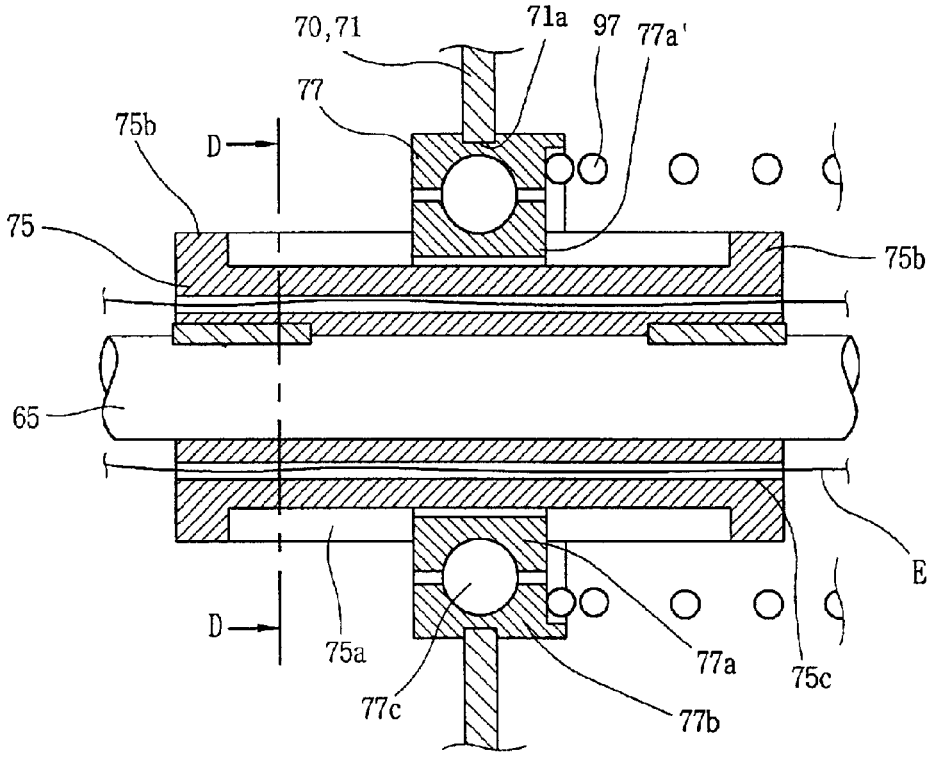
FIG. 5A is a detail view showing portion "C" of FIG. 4.
Figure 5B:
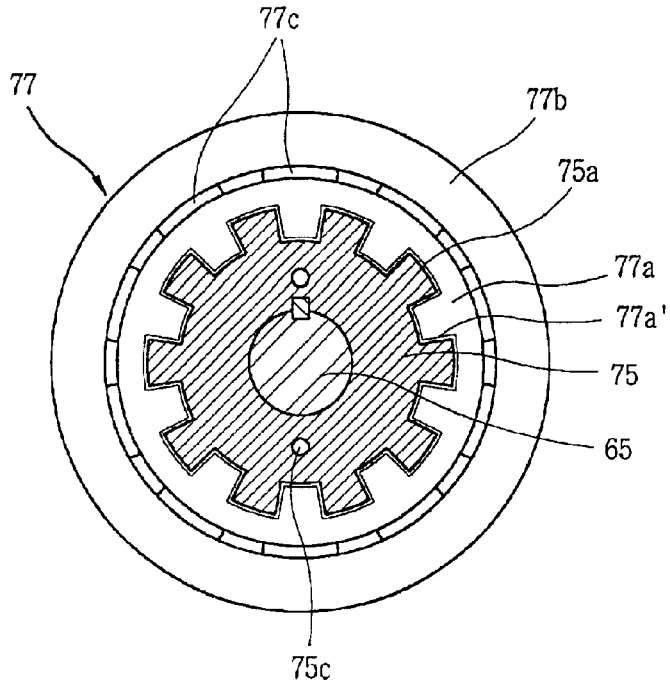
FIG. 5B is a cross-sectional view taken along section line D—D of FIG. 5A.

FIG. 5A is a detail view showing portion "C" of FIG. 4, and FIG. 5B is a cross-sectional view taken along section line D—D of FIG. 5A. With reference to FIGS. 5A and 5B, the moving supporting means is described.

The moving supporting means includes a guide bush 75 formed in a cylindrical shape being fixed around the supporting shaft 65, and a bearing 77 being locked with the guide bush 75 in the rotary direction under the condition that it is installed in the hole 71*a* of the power brush 70 being combined with the guide bush 75 by a serration method so that it can perform linear movements.

The guide bush 75 is fixed on the supporting shaft 65 by the spline combining method, and has guide teeth 75*a* which are composed of protrusions and grooves extendingly formed in the shaft direction so that the bearing 77 is combined with the guide teeth 75*a* formed on the circumferential surface of the guide bush 75. At both end parts of the guide bush 75, a stopper 75*b* is formed for determining the linear moving stroke of the power brush 70 by restricting the movement of the bearing not to be exceeded.

At the guide bush 75, the stator 81 of the rotary operating device 80 and a cable hole 75*c* to supply a power source to the solenoid coil 91 of the linear operating device 90 are formed.

The bearing 77 can be composed of a conventionally used ball bearing or roller bearing, and in the present embodiment the ball bearing is applied.

The ball bearing includes an inner race 77*a* combined with the guide bush 75, an outer race 77*b* fixed in the hole 71*a* of the power brush 70, and balls 77*c* installed between the inner race 77*a* and the outer race 77*b*. Particularly, on the inner circumferential surface of the inner race 77*a*, engaging teeth 77*a*' are engaged with the guide teeth 75*a* of the guide bush 75 by a serration method, like the guide teeth 75*a* of the guide bush 75 are formed.

The operation of the suction head having the power brush in accordance with the present invention with the above structure will be described as follows.

When the fan motor assembly of the cleaner body 50 in FIG. 3 is operated, a suction force is generated in the head case 61 and debris such as dusts and the like are sucked together with the air through the suction hole 62.

At this time, when electric power is supplied to the stator 81 of the rotary operating device 80, the rotor 85 rotates around the supporting shaft 65 as a single body with the power brush 70 and the brush part 73 of the power brush 70 is contacted with the object to be cleaned.

Also, when electric power is applied to the solenoid coil 91 of the linear operating device 90, flux generated from the solenoid coil 91 passes the inner portion of the solenoid coil 91 and the moving core 95, and then returns to the solenoid coil 91.

At this time, the moving core 95 and power brush 70 linearly moves along the supporting shaft 65 to the direction that magnetic resistance is lowered among the passages of the flux, and the springs 96 and 97 respectively store up compressive and tensile elastic force.

Later, when electric power supplied to the solenoid coil is cut off, the power brush 70 is returned to its original position due to the elastic force of the compression and tension springs 96 and 97. When electric power supplied to the solenoid coil 91 is repeatedly turned on and off, the power brush 70 repeats its linear reciprocating movement along the supporting shaft 65.

Therefore, the rotary operating device 80 and linear operating device 90 are operated at the same time, the power brush 70 rotates and simultaneously performs reciprocating movement in the horizontal direction. Therefore, the dislodging of debris from an object to be cleaned is improved.

Namely, conventionally, the power brush dislodged debris by moving in a rotary direction, that is, moving in just one direction when contacting and brushing the object to be cleaned. On the other hand, in accordance with the present invention, the power brush 70 dislodges debris from an object to be cleaned by moving in more than one direction such as in the rotary and horizontal directions and the like, while contacting and brushing the object to be cleaned. Accordingly, the debris on the object to be cleaned can be efficiently removed and sucked.

Therefore, the present invention can improve cleaning performance of the cleaner by improving the debris removing function of the power brush 70.

Also, in the present invention, the size of the suction head 61 can be reduced compared with the conventional suction head having an additional operating device outside the power brush, by installing the rotary operating device 80 within the power brush 70 itself.

The suction head having the power brush in accordance with the present invention can improve the cleaning performance by improving the debris removing function since the power brush performs rotary and linear movements simultaneously, and the brush can perform rotary and sliding movements while contacting and brushing the object to be cleaned.

Also, the suction head having the power brush in accordance with the present invention enables a compact composition structure by reducing the size of the head case since the rotary and linear operating devices are installed within the power brush.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A suction head for a vacuum cleaner, comprising:

a head case connected to a cleaner body via a connecting tube and having a suction hole in a lower surface thereof;

a power brush positioned in the head case and externally protruding from the head case through the suction hole so as to allow contact with an object to be cleaned;

a supporting means fixed in the head case for supporting the power brush to allow rotary and linear movements of the power brush;

a rotary operating means installed within the power brush between the supporting means and the power brush for rotatively operating the power brush; and a linear operating means positioned between the supporting means and the power brush for horizontally reciprocating the power brush along the supporting means.

2. The suction head of claim 1, wherein the power brush is cylindrical in shape and has a plurality of bristles which are formed on a circumferential surface thereof for contacting with the object to be cleaned.

3. The suction head of claim 2, wherein the plurality of bristles are arranged in a spiral shape on the circumferential surface of the power brush.

4. The suction head of claim 1, wherein the supporting means comprises:

a supporting shaft with each end fixed to an inner wall of the head case, the supporting shaft receiving and supporting the power brush thereon;

a linear moving guide means positioned between the supporting shaft and the power brush for guiding linear movement of the power brush linearly along the supporting shaft; and a bearing installed between the linear moving guiding means and the power brush, to facilitate rotation of the power brush relative to the linear moving guide means.

5. The suction head of claim 4, wherein the linear moving guide means is a guide bush fixed to the supporting shaft, the guide brush having a cylindrical shape and being in contact with an inner race of the bearing in a serration structure.

6. The suction head of claim 5, wherein the guide bush has a stopper at both end portions thereof to restrict linear movement of the power brush.

7. The suction head of claim 5, wherein the guide bush has a hole for passing an electric cable therethrough which supplies electric power to the rotary operating means and the linear operating means.

8. The suction head of claim 1, wherein the rotary operating means is a rotary motor comprising a stator fixed to the supporting means and a rotor fixed on an inner circumferential surface of the power brush.

9. The suction head of claim 1, wherein the linear operating means comprises:

a solenoid coil fixed to the supporting means for generating electromagnetic flux;

a moving core fixed to an inner circumferential surface of the power brush for generating a linear moving force in accordance with the electromagnetic flux generated by the solenoid coil; and elastic means supported in the head case, for generating an elastic force that opposes a force generated between the solenoid coil and the moving core.

10. The suction head of claim 9, wherein the elastic means is installed between both side surfaces of the power brush and both inner wall surfaces of the head case, respectively, and provides the elastic force to the power brush so that the power brush performs linear reciprocating movement in the longitudinal direction along the supporting shaft.

11. A suction head for a vacuum cleaner with a power brush, comprising:

a head case connected to a cleaner body via a connecting tube and having a suction hole in a lower surface thereof;

a power brush positioned in the head case and formed externally protruding from the head case through the suction hole so as to allow contact with an object to be cleaned;

a supporting means fixed in the head case, for supporting the power brush and allowing linear movement of the power brush; and a linear operating means installed within the power brush between the supporting means and outer portions of the power brush, for moving the power brush in a linear direction.

12. The suction head of claim 11, wherein the linear operating means comprises:

a solenoid coil fixed to the supporting means for generating electromagnetic flux;

a moving core fixed to an inner circumferential surface of the power brush for generating a linear moving force in accordance with the electromagnetic flux generated by the solenoid coil; and elastic means supported in the head case for providing an elastic force to the power brush so that the power brush performs linear reciprocating movement in the longitudinal direction.

13. A suction head, comprising:

a power brush;

a case configured to receive the power brush;

a support mechanism configured to be fixed in the case and to allow for both rotary and linear movement of the power brush;

a power brush system provided within the power brush and configured to provide both the rotary and linear movement of the power brush; and a suction hole formed in the case and configured to exert a suction force generated by an external source therethrough.

14. The suction head of claim 13, wherein a portion of the power brush is configured to protrude through the suction hole.

15. The suction head of claim 14, wherein the power brush system comprises:

a rotary operating device provided between the support mechanism and the power brush and configured to rotate the power brush about a central axis; and a linear operating device provided between the support mechanism and the power brush and configured to move the power brush in a linear direction along the central axis.

16. The suction head of claim 14, wherein the support mechanism comprises:

a support shaft, wherein each end of the support shaft is fixed to a respective inner wall of the case, and wherein the support shaft is configured to extend through a central portion of the power brush;

a linear guide positioned between the support shaft and the power brush and configured to guide the linear movement of the power brush along the support shaft; and a bearing installed between the linear guide and the power brush and configured to facilitate rotation of the power brush relative to the linear guide.

17. The suction head of claim 15, wherein the rotary operating device comprises a rotary motor, the rotary motor comprising a rotor provided on an inner circumferential surface of the power brush and a stator fixed to the support mechanism.

18. The suction head of claim 15, wherein the linear operating device comprises:

a solenoid fixed to the support mechanism and configured to generate an electromagnetic flux;

a moving core fixed to an inner circumferential surface of the power brush and configured to generate a linear force based on the electromagnetic flux generated by the solenoid; and an elastic device provided in the case and configured to generate an elastic force in opposition to the linear force generated by the moving core.

19. The suction head of claim 15, wherein the power brush is configured to move in a rotary and linear direction simultaneously when both the rotary operating device and the linear operating device are engaged.

20. The suction head of claim 15, wherein the linear movement of the power brush along the central axis comprises a reciprocal linear movement.

* * * * *